US011939133B2

(12) United States Patent
Stadel et al.

(10) Patent No.: US 11,939,133 B2
(45) Date of Patent: Mar. 26, 2024

(54) VALVE FOR A PACKAGING CONTAINER

(71) Applicant: Syntegon Technology GmbH, Waiblingen (DE)

(72) Inventors: Hans-Peter Stadel, Lorch (DE); Jenny Haase, Allmersbach (DE); Holger Poell, Stuttgart (DE)

(73) Assignee: Syntegon Technology GmbH, Waiblingen (DE)

( * ) Notice: Subject to any disclaimer, the term of this patent is extended or adjusted under 35 U.S.C. 154(b) by 157 days.

(21) Appl. No.: 17/641,627

(22) PCT Filed: Sep. 18, 2020

(86) PCT No.: PCT/EP2020/076115

§ 371 (c)(1),
(2) Date: Mar. 9, 2022

(87) PCT Pub. No.: WO2021/053150

PCT Pub. Date: Mar. 25, 2021

(65) Prior Publication Data

US 2022/0332490 A1 Oct. 20, 2022

(30) Foreign Application Priority Data

Sep. 19, 2019 (DE) ..... 10 2019 214 317.2

(51) Int. Cl.
*B65D 77/22* (2006.01)

(52) U.S. Cl.
CPC ..... *B65D 77/225* (2013.01); *Y10T 137/782* (2015.04); *Y10T 137/7882* (2015.04)

(58) Field of Classification Search
CPC .. B65D 77/225; B65D 2205/00; B65D 33/01; Y10T 137/7879; Y10T 137/7882;
(Continued)

(56) References Cited

U.S. PATENT DOCUMENTS 1,416,771 A * 5/1922 Babson ..... F16K 15/16 137/845
2,856,955 A * 10/1958 Winkelman ..... F16K 15/1401 137/512

(Continued)

FOREIGN PATENT DOCUMENTS

EP 0602418 B1 2/1998
EP 0760790 B1 6/2000

(Continued)

OTHER PUBLICATIONS

International Preliminary Report on Patentability for Application No. PCT/EP2020/076115 dated Mar. 15, 2022 (6 pages).

(Continued)

*Primary Examiner* — Jessica Cahill
(74) *Attorney, Agent, or Firm* — Michael Best & Friedrich LLP

(57) ABSTRACT

A valve for a packaging container is proposed, wherein the valve comprises at least one base film (10) with an opening (11), at least one frame film (13) encompassing a free region (17), and at least one membrane (12) which is arranged on the base film (10) and covers the opening (11), wherein a fluid is provided between the membrane (12) and the base film (10), wherein the membrane (12) is connected to a surrounding film (20) via at least one connection region (22), the surrounding film (20) being connected on one side to the base film (10) and on its other side to the frame film (13) and the membrane (12) being arranged movably within the free region (17), wherein the surrounding film (20) is open at least in one point, such that a channel (18) is formed.

16 Claims, 3 Drawing Sheets

(58) Field of Classification Search
CPC ..... Y10T 137/7884; Y10T 137/7891; Y10T 137/7885; Y10T 137/782
See application file for complete search history.

(56) References Cited

U.S. PATENT DOCUMENTS

| | | | | |
|---|---|---|---|---|
| 5,048,846 | A | 9/1991 | Ichikawa | |
| 5,427,839 | A | 6/1995 | Buchner et al. | |
| 5,727,881 | A | 3/1998 | Domke | |
| 6,662,827 | B1 | 12/2003 | Clougherty et al. | |
| 9,920,848 | B2 * | 3/2018 | Rosa | F16K 15/16 |
| 10,358,275 | B1 * | 7/2019 | Cramer | F16K 17/0453 |
| 2012/0048853 | A1 | 3/2012 | Stadel et al. | |
| 2012/0243807 | A1 * | 9/2012 | Pascoe | B65D 77/225 383/103 |
| 2012/0313024 | A1 * | 12/2012 | Eiermann | F16K 15/144 251/294 |
| 2014/0263292 | A1 * | 9/2014 | Bosman | B65D 77/225 493/128 |
| 2015/0135967 | A1 | 5/2015 | Hoffman et al. | |
| 2017/0052544 | A1 * | 2/2017 | Soechtig | G05D 7/0113 |

FOREIGN PATENT DOCUMENTS

| | | | |
|---|---|---|---|
| EP | 2396244 | B1 | 6/2013 |
| JP | H0324379 | A | 2/1991 |
| WO | 2016072663 | A1 | 5/2016 |

OTHER PUBLICATIONS

German Patent Office Search Report for Application No. 102019214317.2 dated Apr. 15, 2020 (9 pages including English translation).
Translation of International Search Report for Application No. PCT/EP2020/076115 dated Dec. 8, 2020 (2 pages).

* cited by examiner

VALVE FOR A PACKAGING CONTAINER

BACKGROUND

The present invention concerns a valve, in particular an overpressure valve for a packaging container.

Valves of this kind are used in packaging technology if the filling material tends to outgassing as is the case, for example, with freshly roasted coffee. Thus an overpressure valve for a packaging container is known, for example, from EP 760790 B1, with a base plate that is fastened to the wall of the packaging container and comprises a central valve hole covering a through hole in the wall of the packaging container, and with a valve membrane that covers the valve hole and is fastened to the base plate with two parallel edge zones leaving a channel zone free, with the valve membrane lying tightly upon the base plate in a closed position. The valve hole is formed of at least two intersecting and/or overlapping circle-shaped openings. From EP 2396244 B1 a generic overpressure valve is known which comprises a base body with a two-step deepening and a membrane, the membrane having a deformable surface that is oriented toward a sealing surface. The base body has a rather complex structure. A further generic valve is known from EP 602418 B1. Furthermore, from WO 2016/072663 A1 a valve for a packaging container is already known, comprising at least one base element which is implemented as a pot-shaped synthetic or metal component, with an opening, further comprising at least one frame element which is implemented as a pot-shaped synthetic or metal component and encompasses a free region, and comprising at least one membrane, which is arranged on the base element and covers the opening, wherein a fluid is provided between the membrane and the base element.

SUMMARY

With respect thereto, the valve for a packaging container according to the invention has the advantage that the valve can be produced and applied in a simpler and more cost-efficient manner. Furthermore, the method according to the invention is distinguished by a considerably reduced material input. The principal construction of the valve may be attached to the packaging container both outside the packaging container as well as, in a certain exemplary implementation, within the packaging container. This is enabled, according to the invention, by the membrane being arranged at least partly on a base film floating and/or freely movable within the free region. As the membrane is connected to a surrounding film via a connection region in such a way that the membrane is otherwise freely movable, the membrane is present in the form of a web in the production of the valve and is therefore particularly easily introducible into the construction by a continuous film web that is in one piece. The production process is further simplified. The membrane is moreover no longer connected to the base body over a large area and is therefore considerably less subject to external influences, like for example warpage. According to the invention, the surrounding film is open at least in one point such that a channel is formed. An overpressure is reliably reducible via this channel. At the same time, the surrounding film may be embodied in a one-part implementation. As a result, handling is simplified. Particularly preferentially the connection region is arranged opposite the channel. This permits an especially favorable lifting of the membraned toward the channel, for the purpose of reducing the overpressure in the packaging container. The proposed construction with a base film, a frame film and, if applicable, a cover film (quasi something like a double-T beam) results in a high degree of bending stiffness with comparably little material input. The valve according to the invention furthermore permits providing the membrane with a pre-tension, which may be helpful for the function of the valve. The valve combines the favorable valve characteristics of an injection-molded valve with those of a film valve. It provides very low opening pressures and closing pressures. The valve is built from several film layers which are, for example, produced on rotary punching tools and are then laminated upon one another. Joining is ideally effected via a welding connection. Alternatively, an adhesive agent like glue could be applied. The proposed valve is preferentially producible from a single type of material and is thus easily recyclable and hence environment-friendly and has improved welding properties. In an expedient further development, the film is made of polypropylene. However, renewable materials, e. g. synthetic materials based on sustainable raw materials or bio-degradable synthetic materials, would also be conceivable.

In an alternative implementation that is covered by the idea of the invention, the valve is embodied free of a channel. In the alternative implementation the valve for a packaging container comprises at least one base film with an opening, at least one frame film surrounding the free region and at least one membrane, which is arranged on the base film and covers the opening, wherein a fluid is provided between the membrane and the base film, wherein the membrane is connected to a surrounding film via at least one connection region, wherein the surrounding film is connected on one side to the base film and on its other side to the frame film, the membrane being arranged movably within the free region. In the production of the valve, the membrane is thus present as a web and is thus especially easily introducible into the construction by a continuous film web that is in one piece.

In an expedient further development, the surrounding film is implemented in such a way that it encompasses the membrane at least partially in a circular shape or in a U shape. This geometry ensures simple attachment of the surrounding film on the base film and/or on the frame film while maintaining the functionality that is described above.

In an expedient further development, the thickness of the frame film is greater than the thickness of the membrane, preferably greater by 75% to 225%. This enables sufficiently favorable freedom of movement of the membrane toward the free region.

In an expedient further development, the base film and/or the frame film and/or the cover film are/is implemented of polypropylene, OPP, PET, polyolefin or of a synthetic material, preferably of sustainable raw materials or of bio-degradable synthetic materials. This allows augmenting reusability and/or environmental compatibility.

In a possible method for producing the valve for a packaging container, the surrounding film is connected on the one side to the base film and on its other side to the frame film, and the membrane is arranged so as to be movable within the free region. In particular, a cover film is applied onto the frame film.

In an expedient further development, the opening and/or the free region and/or the membrane are/is punched out. These steps can be executed very easily with the selected film materials, which further simplifies production.

Especially expediently, a fluid is applied onto the base film and/or onto the membrane before application of the membrane. In particular, the fluid is applied between the base film and the membrane before the surrounding film with the connected membrane is applied onto the base film. This ensures the membrane being securely connected to the base film in the subsequent production points as well. Alternatively, it is possible that the fluid is applied later on in the applicator which connects the valve to the packaging material.

In an expedient further development, the base film and/or the surrounding film and/or the frame film and/or the cover film are connected via a welding connection, in particular laminated. In the production process this allows dispensing with glue, which is undesirable because of increased cleaning requirements and which is moreover expensive. In the case of an inside-situated valve this allows avoiding glue located on the side facing toward the product.

The production of the opening as well as the production of the free region can be realized in one and the same step with only one punching tool. This further simplifies production. By introducing the membrane in the connection with the surrounding film, a high level of position accuracy is achievable.

Further expedient developments will become apparent from further dependent claims and from the description.

BRIEF DESCRIPTION OF THE DRAWINGS

Implementations of the invention will be described in detail with reference to the included figures. It is shown in.

DETAILED DESCRIPTION

In the following the exemplary embodiments of the invention will be described in detail with reference to the figures.

Figure 1:
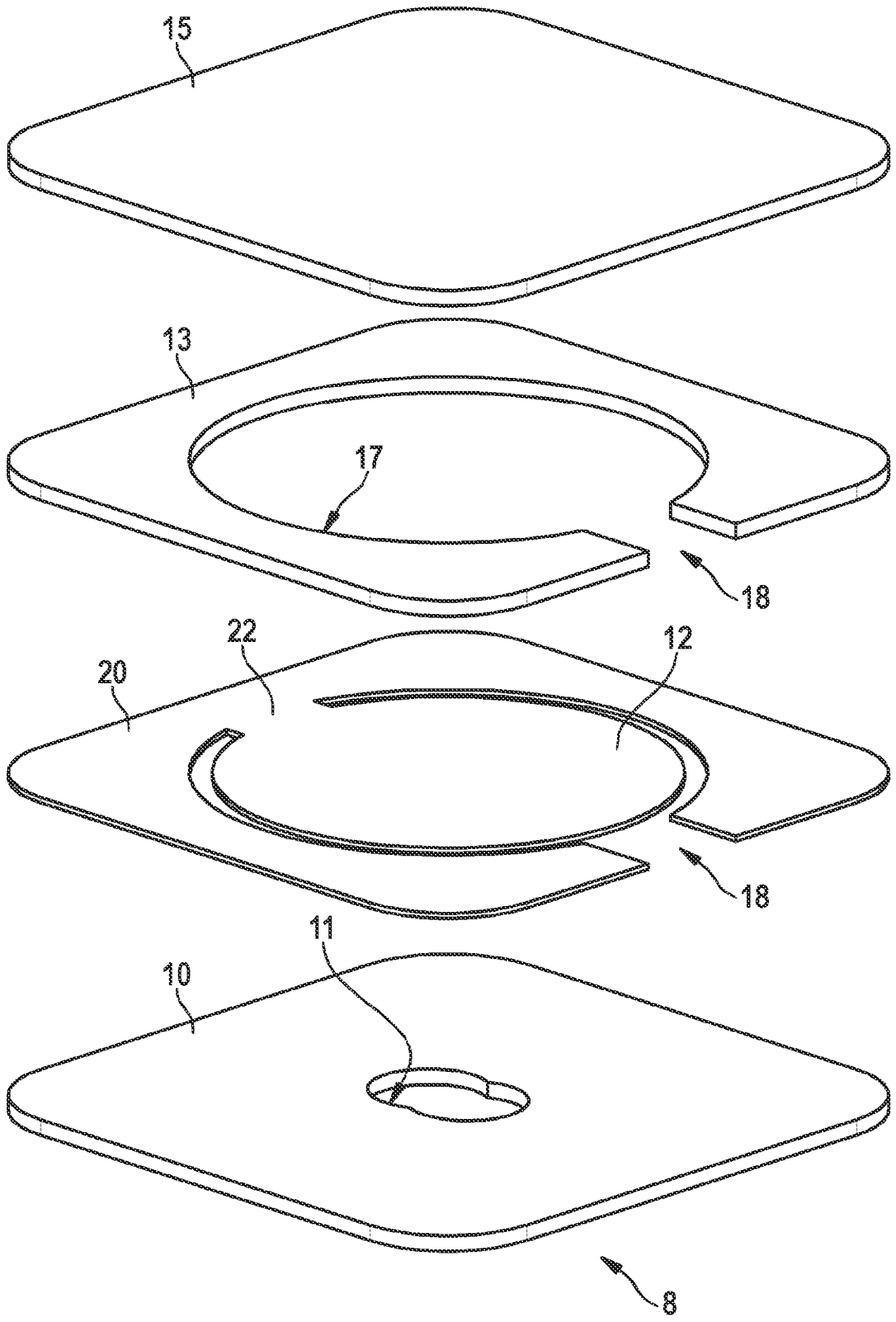
FIG. 1 an exemplary embodiment of an outside-situated valve, in which the membrane is partly connected to the surrounding film, FIG. 2 a production method for the valve of FIG. 1, in which individual film webs are punched and welded, and FIG. 3 an exemplary embodiment of an inside-situated valve, in which the membrane is partly connected to the surrounding film.

FIG. 1 shows an exemplary embodiment of the valve 8. The valve 8 comprises a base film 10 with at least one opening 11. The opening 11 has, for example, the geometry of two intersecting and/or overlapping circles. The membrane 12 is connected to a surrounding film 20 via at least one, in particular narrow, connection region 22. However, the major portion of the membrane 12 is still freely movable. The membrane 12, the connection region 22 and the surrounding film 20 are thus implemented by a single part. The surrounding film 20 encompasses the membrane 12 except for a small channel 18. The at least one connection region 22 between the surrounding film 20 and the membrane 12 is realized on a middle of a side of the surrounding film 20. The membrane 12 and the surrounding film 20 are implemented of the same film, respectively are embodied in a one-part implementation. The thickness of the surrounding film 20 hence corresponds to the thickness of the membrane 12. In the exemplary embodiment the surrounding film 20 is on one side open in a relative narrow manner with respect to the total width. This enables the forming of the channel 18.

A large portion of the membrane 12 is capable of lifting free off the opening 11, respectively off the base film 10. This is ensured by a free region 17 formed by the frame film 13 that is situated above the base film 10. The free region 17 is implemented so as to allow the membrane 12 securely lifting off upwards into said free region 17. For this purpose, the free region 17 of the frame film 13 is realized somewhat larger than the membrane 12 and is arranged above the membrane 12. The contour of the surrounding film 20 is at least partly aligned with the frame film 13. The surrounding film 20 is connected with the frame film 13.

The connection of the base film 10 to the frame film 13 and/or of the frame film 13 to the cover film 15 is preferably realized via a welding procedure. The films 10, 13, 15 are implemented so as to be weldable. The films 10, 13, 15 are preferentially implemented of a synthetic material. Particularly preferentially the valve 8 is implemented of films with the same material. Here polypropylene is especially suitable. Due to the uniform material of the different films 10, 13, 15, re-usability is simplified. Synthetic materials based on sustainable raw materials or bio-degradable synthetic materials may also be utilized. The base film 10 and/or the frame film 13 and/or the cover film 15 may, for example, be implemented of polypropylene, preferentially of OPP (oriented polypropylene), i. e. a propylene that is stretched longitudinally or biaxially. The base film 10 and/or the frame film 13 and/or the cover film may alternatively be implemented of PET or of a composite film, like for example PP-EVOH-PP. The material of the membrane 12 is distinguished by a high oxygen barrier. For example, the membrane 12 is made of PET or of a composite material like PP-EVOH-PP.

Figure 3:
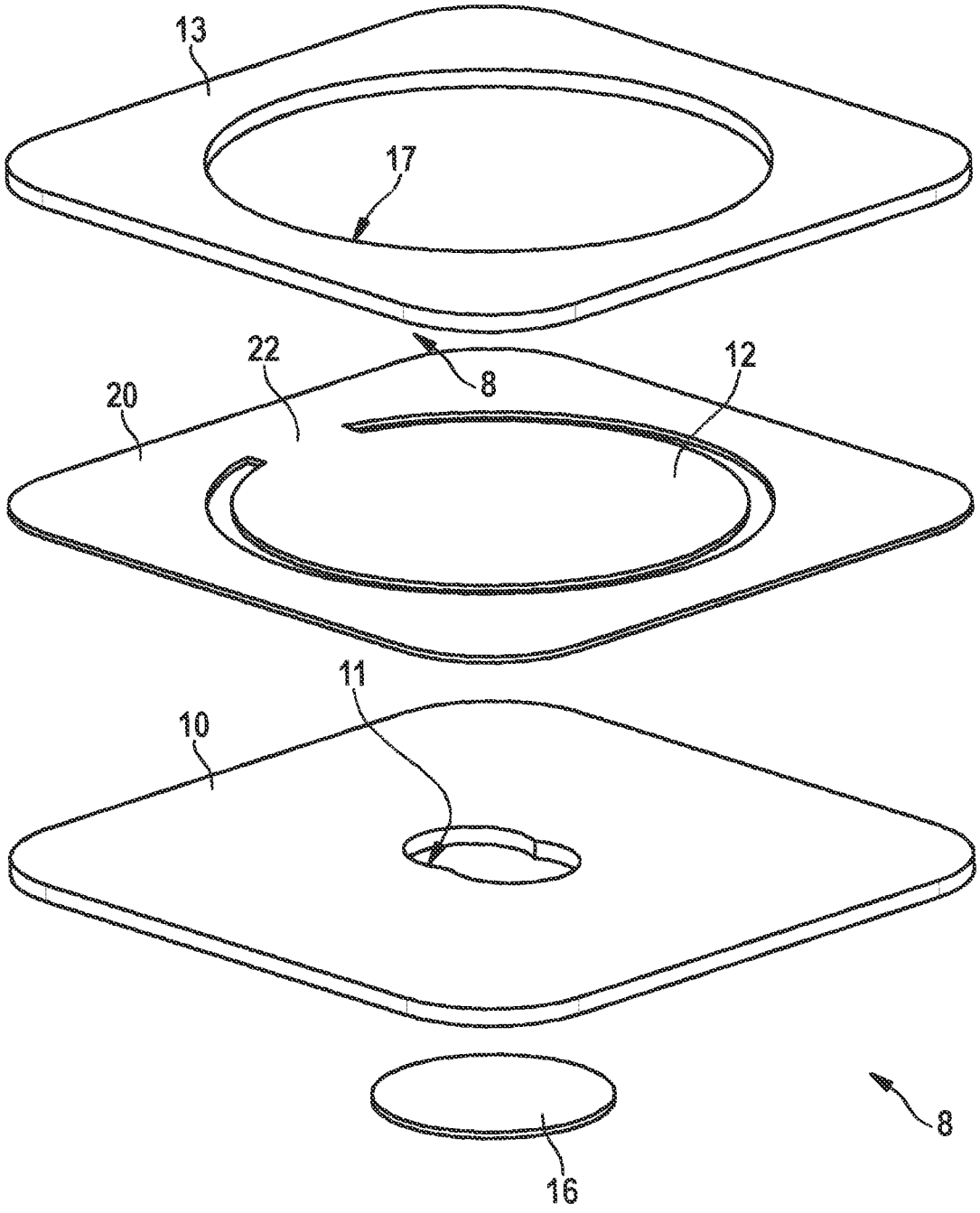

The alternative exemplary embodiment of FIG. 3, which is also covered by the idea of the invention, is realized as an inside-situated valve 8. With respect to the exemplary embodiment of FIG. 1, on the one hand there is neither a cover film 15 nor a channel 18. The other side of the opening 11 is covered by a filter 16, in particular a nonwoven filter 16. The filter 16, respectively the nonwoven, is necessary so as to prevent particles of the filling material from entering into the valve 8 between the membrane 12 and the base film 10, which would affect functionality. However, the membrane 12 is in particular, in its turn, connected to the surrounding film 20 via the connection region 22, as a result of which this is a one-part implementation.

The following geometries may be particularly suitable for the valve 8. In the exemplary embodiments of FIG. 1, respectively 3, the edge lengths of the base film 10 may be in the range between preferentially 12.5 mm and 20 mm. The thickness of the base film 10 is preferentially in the range between 0.1 mm and 0.25 mm, and is particularly preferentially for example 0.125 mm. The fluid, for example silicone oil or fluids based on bio-based materials and/or sustainable raw materials, e. g. based on palm oil, coconut oil or the like, is applied as a fluid film. The volume of the fluid film is approximately 2 μl to 5 μl. The thickness of the membrane 12 is, for example, in a range between 0.025 mm and 0.075 mm, and is preferentially 0.05 mm. The thickness of the frame film 13 is, for example, in the range between 0.1 mm and 0.2 mm. The thickness of the frame film 13 is greater than the thickness of the membrane 12. The thickness of an optional cover film 15 is, for example, in the range of 0.05 mm to 0.15 mm, particularly preferentially 0.1 mm. Depending on an application case, material selection, connection methods etc., thicknesses may vary accordingly.

For the production of the membrane 12, for example, a film corresponding to the base area of the base film 10 is punched out so as to provide the circle-shaped contour of the membrane 12. It is advantageous for the production process if the membrane 12 is connected to the surrounding film 20 in at least one point or in several points (respectively by one or several small webs), respectively connection regions 22. The production and positioning of the membrane 12 can thus be simplified. The region 22, respectively regions 22, in which the membrane 12 is still connected to the surrounding film 20, is/are small relative to the circumferential direction of the membrane 12, such that a lifting of the membrane 12 in the free regions is ensured.

It is however also possible that a plurality of connection regions 22 are provided. These connection regions 22 are to be arranged in such a way that a lifting of the membrane 12 off the opening 11 is still reliably possible.

Figure 2:
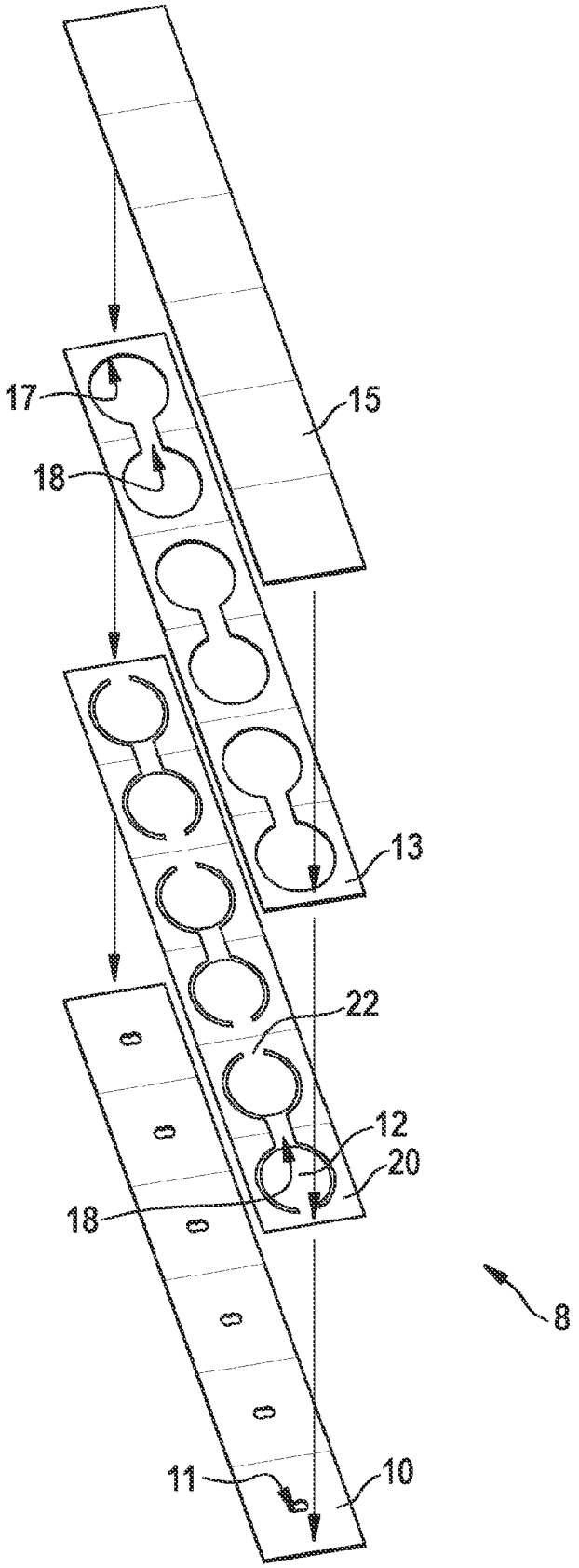

The production process according to FIG. 2 serves for the production of a valve 8 according to FIG. 1. It is distinguished in that in each case separate film webs are fed in for the base film 10, for the surrounding film 20 with the attached membrane 12, for the frame film 13 and/or if applicable for the cover film 15. The individual film strips of the above-mentioned films 10, 13, 15, 20 usually have identical widths.

First of all, the base film 10 is provided. The base film 10 may already have openings 11. Alternatively, the openings 11 may be created, e. g. punched, in situ. The punching is however to be executed before the lamination process.

In a further step, a fluid, respectively a fluid film, is applied onto the base film 10, this is done in the places where later on the membrane 12 will come to rest, in particular in the region surrounding the opening 11. Alternatively, the fluid film could already be applied on the underside of the membrane 12. Alternatively, the fluid could be applied later on, for example in the applicator which connects the valve to the packaging material.

In a further step, the surrounding film 20, with the membrane 12 connected via the connection region 22, is applied onto the base film 10. For the production of the surrounding film 20, with the membrane 12 connected via the connection region 22, and/or with at least one channel 18, a corresponding punching process may create the contours of the membrane 12 and/or may punch out what will be the channel zone 18 later on. By the punching process, the membrane 12 is separated from the surrounding film in such a way that the two are connected to each other only via the at least one connection region 22. The surrounding film 20, with the membrane 12 connected via the connection region 22, is fixedly connected to the base film 10. Preferentially the connection may be generated, as has been described, via a suitable welding connection. For example, hot-air welding, thermal-contact welding, induction welding, cold welding and ultrasonic welding (possibly others as well) may be considered as welding methods. However, alternatively other connection methods like gluing etc. are possible.

Then the frame film 13 is applied onto the surrounding film 20. Herein the free region 17 comes to rest above the membrane 12. This enables a lifting of the membrane 12 into the free region 17. The free region 17 has previously been punched out of the frame film 13. The applied frame film 13 is connected to the surrounding film 20. This may preferably be realized—as described above—via a corresponding welding connection. However, alternatively further connection methods are feasible, like gluing. It is essential that only the surrounding film 20 is connected to the frame film 13 but not the membrane 12. The freedom of movement of the membrane 12, which is movably held only by at least one connection region 22, is thus ensured.

After this the cover film 15 may be applied onto the frame film 13. Then the cover film 15 is connected to the frame film 13. This may preferably be realized—as described above—via a corresponding welding connection. However, alternatively further connection methods are feasible, like gluing. This step could be dispensed with, for example for inside-situated valves 8 which do not require a cover film 15.

The singulation of the valves 8, which are arranged contiguously on a film web, may be realized in the packaging machine, in particular via the afore-described applicator. Alternatively, the singulation could also be realized directly following the joining of the films 10, 13, 15, 20.

The described valves 8 are used, for example, as aroma-protection valves of packagings of outgassing products, like for example coffee beans, ground coffee, fresh dough or the like, in which after a packaging process an overpressure is produced within the packaging that is caused by outgassing filling materials. Pressure relief is brought about by a lifting of the membrane 12 relative to the opening 11, respectively to the base film 10, the pressure then escaping via the free region 17, respectively—in the case of an outside-situated valve—via at least one sidewise channel 18, which is in a connection with the free region 17 and is implemented between the frame film 13 and the cover film 15.

What is claimed is:

1. A valve for a packaging container, comprising at least one base film (10) with an opening (11), at least one frame film (13) encompassing a free region (17), and at least one membrane (12) which is arranged on the base film (10) and covers the opening (11), wherein a fluid is provided between the membrane (12) and the base film (10), wherein the membrane (12) is connected to a surrounding film (20) via at least one connection region (22), the surrounding film (20) being connected on one side to the base film (10) and on its other side to the frame film (13), wherein the membrane (12) is arranged movably within the free region (17), wherein the surrounding film (20) includes an outer perimeter, and wherein the outer perimeter of the surrounding film (20) is open at least in one point such that a channel (18) is formed in the surrounding film (20).

2. The valve according to claim 1, wherein the connection region (22) is arranged opposite the channel (18).

3. The valve according to claim 1, wherein the surrounding film (20) encompasses the membrane (12) at least partially in a circular shape or in a U shape.

4. The valve according to claim 1, wherein the membrane (12) is implemented in a circular shape.

5. The valve according to claim 1, wherein the base film (10), the frame film (13) and the membrane (12) are equally usable and/or arrangeable within a packaging container or outside a packaging container.

6. The valve according to claim 1, wherein a thickness of the frame film (13) is greater than a thickness of the membrane (12).

7. The valve according to claim 6, wherein the thickness of the frame film (13) is greater than the thickness of the membrane by 75% to 225%.

8. The valve according to claim 1, wherein at least one cover film (15) is provided, which is connected to the frame film (13).

9. The valve according to claim 8, wherein the base film (10) and/or the frame film (13) and/or the cover film (15) are/is implemented of polypropylene, PP-EVOH-PP, OPP, PET, polyolefin or of a synthetic material.

10. The valve according to claim 9, wherein the base film (10) and/or the frame film (13) and/or the cover film (15) are/is made of sustainable raw materials or of bio-degradable synthetic materials.

11. The valve according to claim 8, wherein the frame film (13) is connected to the base film (10) and/or to the cover film (15) via a welding connection.

12. The valve according to claim 11, wherein the frame film (13), the base film (10), and/or the cover film (15) are laminated together.

13. The valve according to claim 1, wherein the frame film (13) includes an outer perimeter, and wherein the outer perimeter of the frame film (13) is open at least in one point such that a channel (18) is formed in the frame film (13).

14. The valve according to claim 13, wherein the channel (18) formed in the frame film (13) and the channel (18) formed in the surrounding film (20) connect to form a passageway connecting the opening (11) to an ambient region surrounding the valve (8).

15. The valve according to claim 14, wherein at least one cover film (15) is connected to the frame film (13), and wherein the channel (18) formed in the frame film (13) and the channel (18) formed in the surrounding film (20) are located between the base film (10) and the at least one cover film (15).

16. The valve according to claim 1, wherein the channel (18), viewed in a main extension plane of the surrounding film (20), forms a material-free interruption in the outer perimeter of the surrounding film (20).

* * * * *